US005775395A

United States Patent [19]

Wilkins

[11] Patent Number: 5,775,395

[45] Date of Patent: Jul. 7, 1998

[54] VACUUM FIXTURE

[76] Inventor: David Wilkins, 25 S. Highland St., Winchester, Ky. 40391

[21] Appl. No.: 833,707

[22] Filed: Apr. 9, 1997

Related U.S. Application Data

[60] Provisional application No. 60/016,077 Apr. 10, 1996.

[51] Int. Cl.[6] ..... B25H 1/02; B25B 11/00

[52] U.S. Cl. ..... 144/286.5; 33/23.11; 83/452; 83/460; 144/137; 144/144.1; 144/135.2; 269/1; 269/21; 269/203; 269/283; 269/307; 409/137

[58] Field of Search ..... 83/460, 461; 33/23.08, 33/23.11; 144/134.1, 135.2, 135.3, 137, 144.1, 144.51, 286.1, 286.5; 409/125, 130, 110, 219; 269/1, 2, 21, 203, 283, 307

[56] References Cited

U.S. PATENT DOCUMENTS

| | | | |
|---|---|---|---|
| 4,382,728 | 5/1983 | Anderson et al. | 409/137 |
| 4,946,149 | 8/1990 | Greene | 144/286.5 |
| 5,193,596 | 3/1993 | Patel | 144/286.1 |
| 5,211,092 | 5/1993 | Blasi | 144/286.1 |
| 5,493,767 | 2/1996 | Susnjara | 269/21 |

*Primary Examiner*—W. Donald Bray
*Attorney, Agent, or Firm*—Jack E. Toliver

[57] ABSTRACT

A vacuum fixture table is set up to establish a vacuum with the surface of the table so one side of a workpiece can be subject to a cutting operation. It also holds wooden panels in conjunction with a template holding frame without nailing or clamping, thus preventing damage to template and speeding up the cutting operation.

9 Claims, 6 Drawing Sheets

VACUUM FIXTURE

This application is based on the disclosure in a prior provisional application entitled Vacuum Fixture, Ser. No. 60/016,077 filed Apr. 10, 1996 by the inventor of this application, David Wilkins, of Winchester, Ky.

BACKGROUND OF THE INVENTION

In the wooden cabinet making trade it is common to use jigs and fixtures to hold the work. A router is guided by templates to cut intricate designs in cabinet door panels or other flat decorative wood surfaces. For example, a panel which is being made into a cabinet door facing is clamped to a table, a template is positioned over the panel, and either nailed or clamped to it. Templates are used in a series to produce progressive cuts for developing a final intricate design created by guiding a router in the template pattern to make a three dimensional cut in the panel as the router bit, which has a smooth, bevel ring, traces the edge of the pattern, allowing the tip of the bit to progressively carve the wood below to a depth determined by the width of the opening in the pattern of the template. Template carving systems are available commercially from CMT Tools of Oldsmar, Fla., known as the 3D Router Carver™, as disclosed in U.S. Pat. No. 5,146,965. A main difficulty with such carving systems has been the set up time and the inherent damage caused to the decorative panel from nailing or clamping the template to it so it doesn't slip under the router.

SUMMARY OF THE INVENTION

The present invention pertains especially to a vacuum fixture for use in such a template carving system. The vacuum fixture, according to the invention, comprises a flat, horizontal clamping table approximately two feet by three feet in size having a grid pattern laid out on it to aid in centering the workpiece. Centered in the grid pattern is a vacuum seal of a prescribed area to create a vacuum chamber when the workpiece is placed on the seal. A control valve on the side of the table connects to a source of compressed air to evacuate the chamber using a venturi ejector to exhaust most of the air trapped in the chamber clamping the workpiece to the table. A pair of indexing beams on the table position a template holding frame having a template cutout above the workpiece in which the template exactly fits so as to be held against moving as the router travels over the pattern.

It is a primary object of the invention to provide a vacuum fixture table for holding a workpiece having a relatively flat, smooth surface on one side for establishing a vacuum with the surface of the table so that the opposite side can be subjected to a cutting operation.

Another object of the invention is to provide a vacuum fixture table for holding wooden panels in conjunction with a template holding frame. The frame is positioned over the vacuum clamped workpiece centered on the table. Indexing beams hold the frame in a reliably centered fashion over the workpiece. The template is merely dropped into the frame without nailing or clamping which avoids the damage caused by nailing or clamping the template directly to the workpiece which required considerable time and skill to fix afterwards.

DETAILED DESCRIPTION OF THE INVENTION

Figure 1:
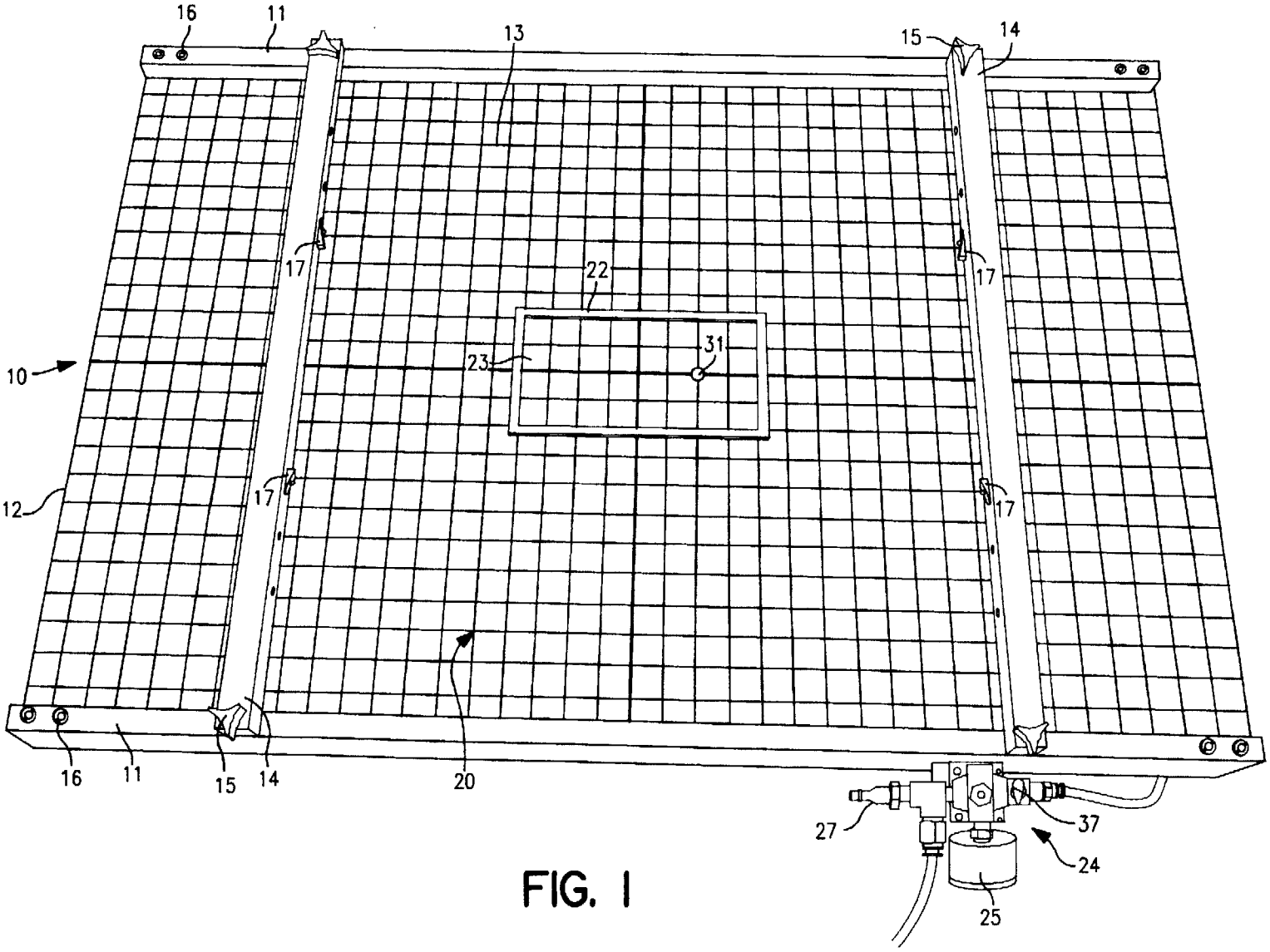
FIG. 1 is a top view of the vacuum fixture table.
Figure 2:
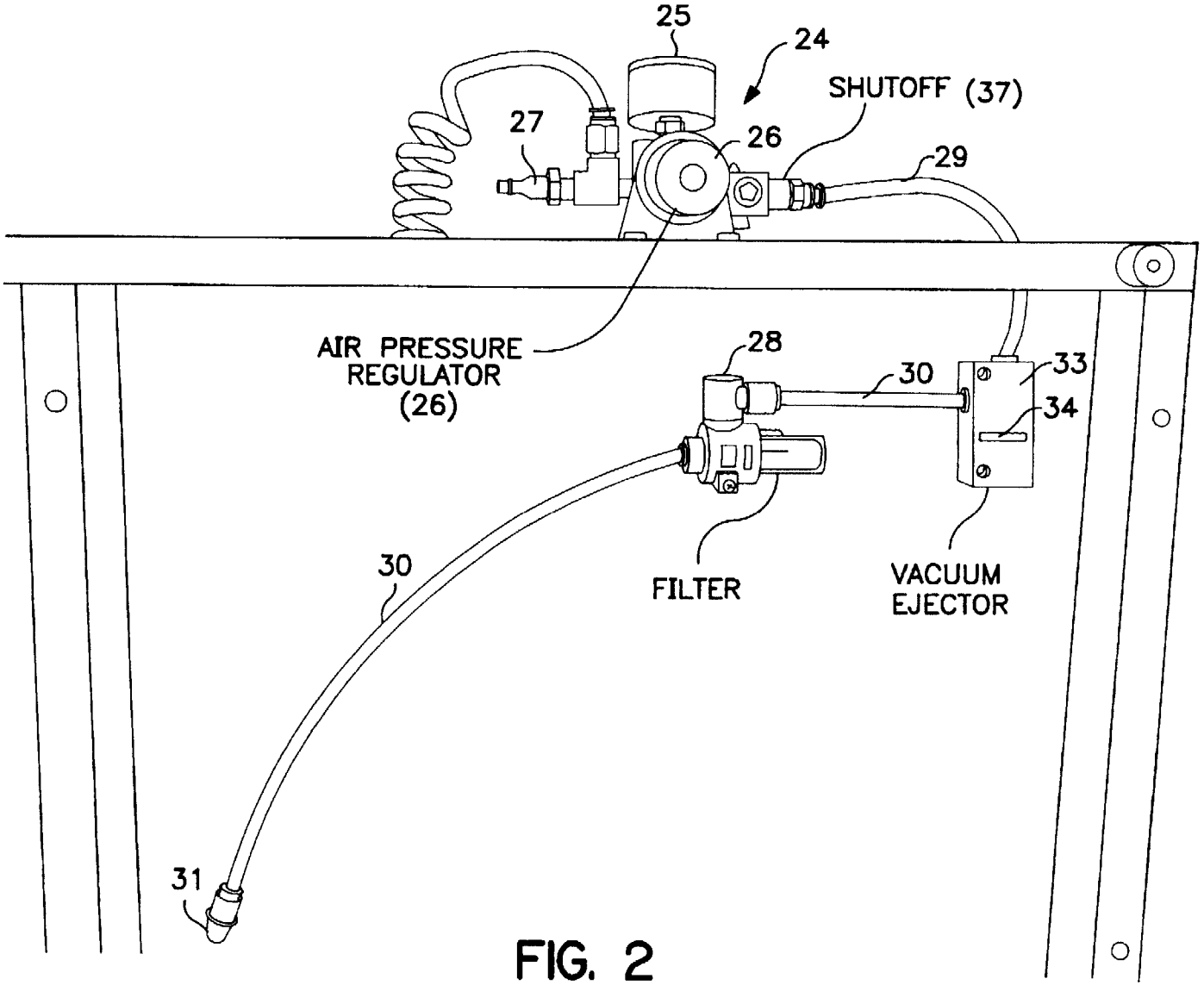
FIGS. 2–2A show the routing the vacuum lines and FIG. 2 A is a schematic diagram of the vacuum system.
Figure 2A:
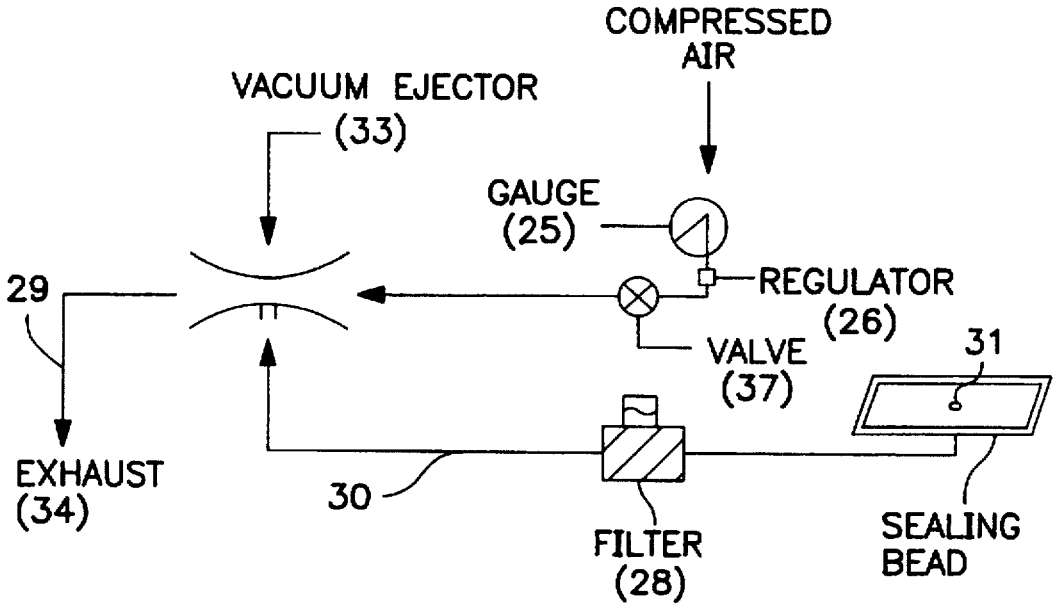
Figure 3:
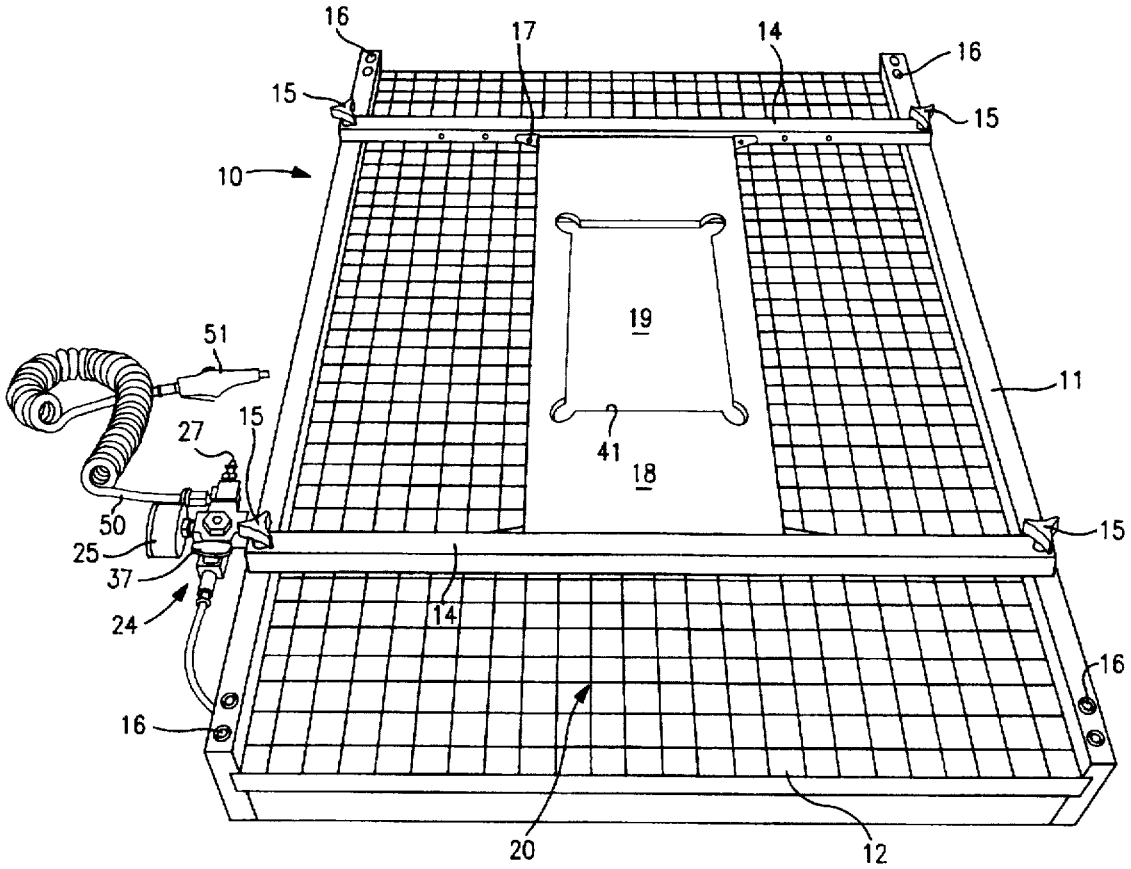
FIG. 3 is a perspective view from one end of the fixture, the workpiece clamped and the pair of indexing beams shown positioning the template holding frame above the workpiece.

Referring to FIG. 1, the vacuum fixture (10) comprises a rectangular table (12) which along its two longest sides has parallel rails (11) the upper surface of which is about one inch above the surface (13) of the table. A pair of indexing beams (14) is clamped by hand screws (15) at each end threaded in predetermined set up holes (16) in the top of the rails (11). The holes (16) establish a longitudinal position relative to the table surface for the transverse indexing beams (14) consistent with a predetermined template size and cooperate with pairs of positioning lugs (17) on the inside facing edges of the beams to center a template holding frame (18)over a workpiece (19) as depicted in FIG. 3. A grid pattern (20) on the table surface (13) is divided into one inch squares for centering the workpiece (19) over a vacuum seal (22) in the center of the table defining a vacuum chamber (23) with the smooth underside of the workpiece. The vacuum seal (22) has a small diameter elastomeric bead glued to the surface (13) defining a predetermined chamber volume of about 32 sq. in. by ¼ in. depth that is evacuated when the workpiece is clamped to the table flattening the bead against the table surface. Referring to FIGS. 2, 2A, a pneumatic valve (24) has a pressure gauge (25) and a regulator (26). A quick attach coupling (27) accepts an air hose (not shown) for delivering air under pressure to the valve (24) and a shutoff valve (37) opens to a line (29) to a venturi vacuum ejector (33) that pulls, or aspirates, the air trapped in the vacuum chamber (23) through a line (30) having an orifice (31) communicating with the vacuum chamber (23) where it is passed through a filter (28) and ejected through an exhaust (34). The workpiece (19) is clamped to the table by evacuating most of the air within the chamber creating a negative pressure of 10–15 to 20–26 inches of Hg with a compressed air pressure of between 40–80 psi. The pressure differential causes the bead (22) to collapse firmly holding the workpiece after it initially was centered for clamping by using the grid pattern (20) to locate it equidistant between the pair of indexing beams (14).

For a larger workpiece, then the cabinet panel (19) in FIG. 3, such as a door panel, the ends can extend below the indexing beams, off the ends of the table, and up to 24 in. between the rails (11) for accommodating panels up to that width, and the clamping force developed is sufficient to firmly hold the larger panels from sliding relative to the table surface.

The template holding frame (18) fits between the pair of indexing beams (14) positioned by holes (16) longitudinally and its lateral position is determined by the pairs of lugs (17) which fasten into pairs of holes on the inside edges of the beams permitting variable sizes of frames relative to the size of the workpiece.

With the variation shown in FIGS. 4–5, the typical thickness of the workpiece (19) would be from ⅜ to ⅞ inches producing a stack height with the template holding frame (18) of more than the one inch gap below the pairs of indexing beams (45) so they serve to block the holding frame from sliding relative to the work, and pairs of stops (46), engage the edges of the frame to hold it laterally from moving relative to the workpiece.

Figure 4:
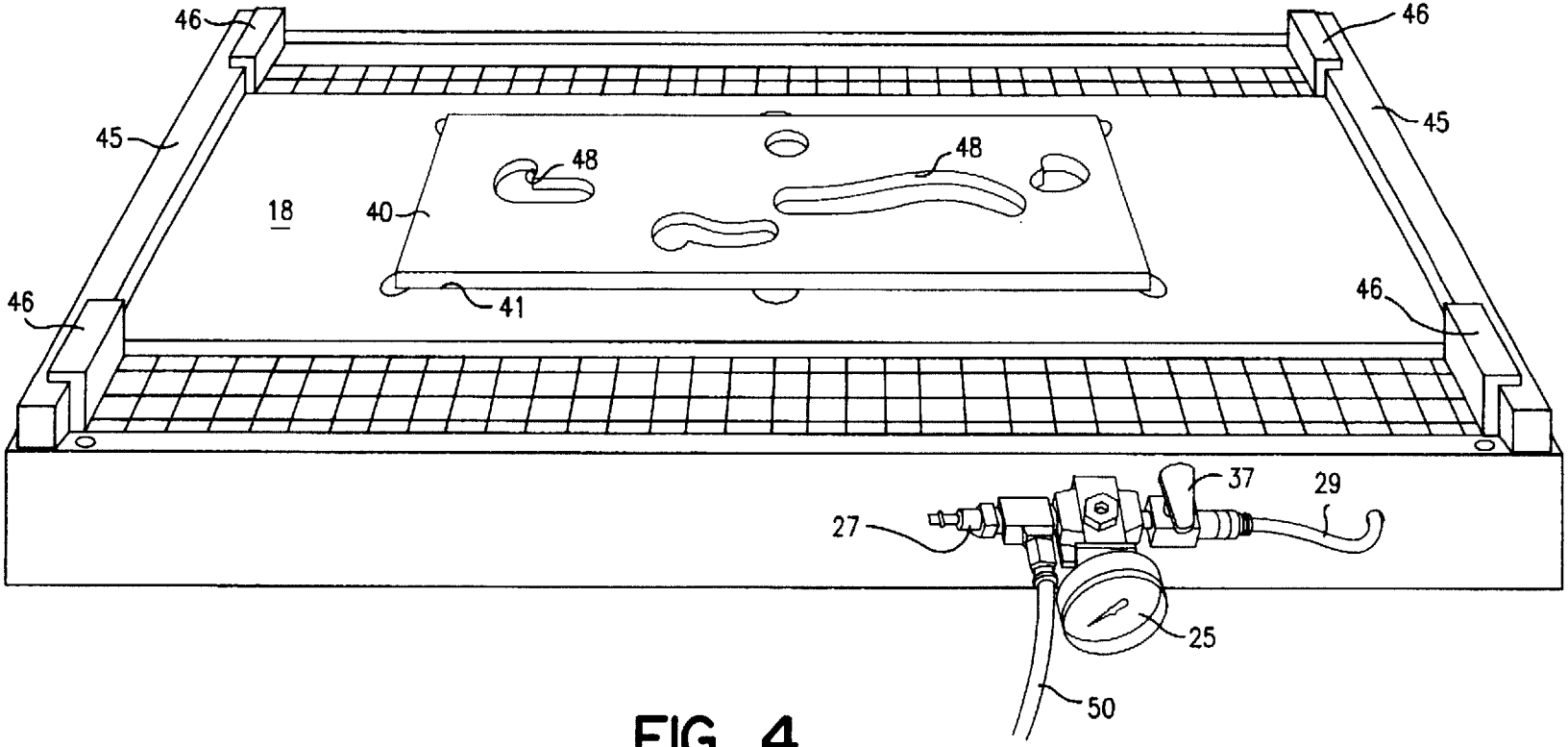
FIG. 4 is a side perspective view of the fixture showing a different method of indexing the template holding frame and carving template.
Figure 5:
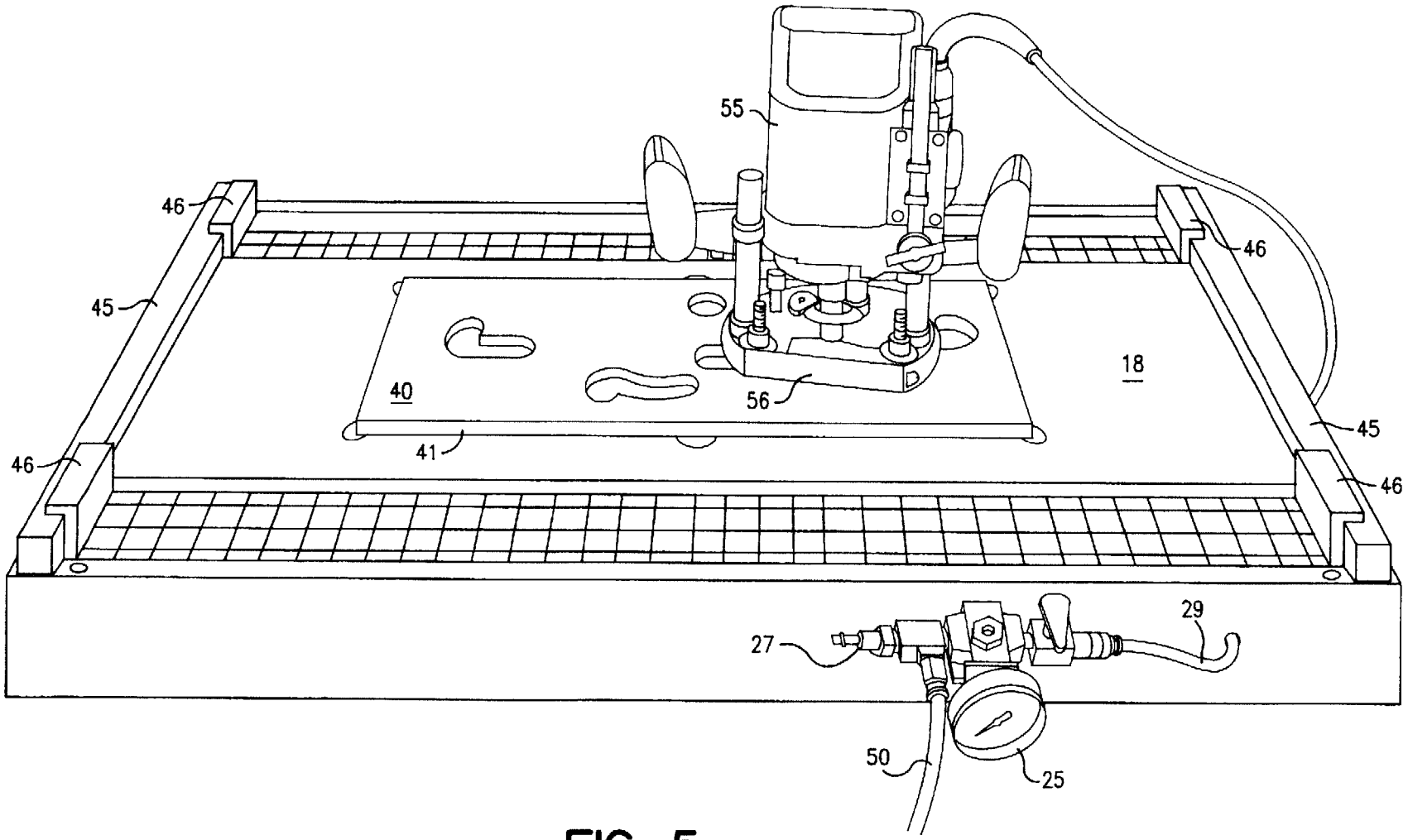
FIG. 5 is a finished set up view of the fixture shown in FIG. 4.

While the embodiment in FIG. 1–3 is preferred, the alternative in FIGS. 4–5 is suitable when the range of adjustment required is not as great, and in either case, the important advantage of the invention is achieved in that neither the template holding frame (18), nor the template (40) needs to be clamped or nailed to the work. As illustrated in FIG. 4, the frame (18) centers a template (40) relative to the workpiece within a rectangular cutout (41) exactly accommodating the template (40) which is merely dropped into the cutout (41) and is thereby automatically centered relative to the workpiece (19) underneath.

Referring to FIGS. 4–5, in operation, a conventional power router (55) is supported on a jig (56). The router will have a carving bit with a conical collar that traces the edges of the template pattern (48) which establishes the depth and shape of the cut in the workpiece below. Successive templates may be quickly positioned in the holding frame developing more rapidly than before intricate three dimensional designs. After cutting the design, the vacuum ejector is shut off returning the vacuum chamber to a normal atmospheric pressure allowing the workpiece to be removed without it having been damaged by nailing or clamping the templates holding frame directly to it.

The vacuum system components are individually available from commercial sources, one such supplier being The Woodhaven Corporation, Davenport, Iowa.

Referring to FIG. 3, an optional hose (50) has a manually operated nozzle (51) that is connected to the valve (24) which can be turned on and compressed air used to blow saw dust off the table surface in preparation for the next set up.

While the invention has been described with reference to particular embodiments, it will be appreciated that variations in structure may be made without departing from the scope of the invention as defined by the appended claims.

I claim:

1. A vacuum fixture having a flat work surface on which a flat workpiece is adapted to be clamped while tracing a template pattern thereon comprising:

a sealing bead defining a vacuum chamber under a portion of the workpiece when placed thereon;

a source of vacuum connectable to the chamber capable of generating a negative pressure therein sufficient to hold the workpiece against movement under working conditions; and a plurality of template indexing elements adjustable relative to the work surface adapted to be set into position to removably hold a template in fixed relationship above the workpiece without directly being attached to the workpiece, the template indexing elements preventing relative movement of the template and workpiece while the vacuum chamber prevents relative movement of the workpiece and work surface as a tool is moved relative to the template in tracing a pattern onto the workpiece underneath.

2. A vacuum fixture according to claim 1 wherein the template indexing elements comprise:

a first pair of indexing elements, one on each first side of the vacuum chamber and spaced equidistant from each other being adapted to engage with a template holding frame to prevent movement of it relative to the workpiece in a first indexing direction; and a second pair of elements, one on each side of each second side of the vacuum chamber and spaced equidistant from each other, being adapted to engage with said template holding frame to prevent relative movement of it in a second indexing direction, the template holding frame being held in fixed relationship to the workpiece thereby which is in turn held in fixed relationship to the work surface by said vacuum chamber and said template holding frame having a cut out directly above the workpiece adapted to receive a plurality of templates of a size to fit within the cut out and thereby be held in fixed relationship to the workpiece, said templates being useable in a series to develop a complex pattern by tracing the successive template patterns onto the workpiece developing the completed pattern on the workpiece in rapid fashion.

3. A vacuum fixture according to claim 2 comprising:

a rectangular table having longitudinal sides and transverse sides on which said work surface exists having a grid pattern to facilitate positioning the workpiece centered on the work surface equidistant from the longitudinal sides and transverse ends of the table.

4. A vacuum fixture according to claim 3 when the first pair of indexing elements comprise a pair of indexing beams extending parallel to said transverse ends of the table spaced above the work surface at least the thickness of a workpiece, detachable fasteners, one on each end of each said indexing beam, a plurality of indexing holes along each longitudinal side of the table to receive said fasteners at each end of said indexing beams to hold them in fixed relation to in said first indexing direction.

5. A vacuum fixture according to claim 4 wherein said second pair of indexing elements comprises a plurality of fasteners adjustable along each said indexing beam engagable with said template holding frame establishing said second indexing direction.

6. A vacuum fixture having a flat work surface on which a flat workpiece is adapted to be clamped while tracing a template pattern thereon with a series of templates successively developing the completed pattern on the workpiece comprising;

a sealing bead fastened to the work surface defining a vacuum chamber with a portion of the workpiece when it is placed thereon;

a source of vacuum connectable to the chamber capable of generating a negative pressure therein sufficient to hold the workpiece against movement relative to the work surface under working conditions; and a template holding frame indexing structure associated with the work surface adapted to hold a template holding frame in fixed relation to the workpiece while the workpiece is in turn held in fixed relationship to the work surface by the vacuum chamber, said template holding frame being adapted to position a series of templates in repeated relationship to said workpiece for rapidly developing a pattern therein without having to permanently secure the template holding frame on templates while working on the workpiece.

7. A vacuum fixture according to claim 6 wherein said template holding frame indexing structure comprises a first pair of indexing elements, one on each side of the vacuum chamber, spaced equidistant from it in a first indexing direction; and a second pair of indexing elements, one on each side of the vacuum chamber, spaced equidistant from it, in a second indexing direction, said first and second pairs of indexing elements being adapted to removably mount in fixed relation to the workpiece a template holding frame, and a cut out portion of said frame positioned directly above the workpiece, adapted to receive a plurality of templates, one after the other, dropped in the cut out portion of the template holding frame.

8. A vacuum fixture having a rectangular table providing a work surface on which a grid pattern is inscribed to aid in positioning a flat workpiece equidistant from the sides and ends of the table comprising:

a pair of rails, one on each side of the table, projecting above the work surface, at least the thickness of the workpiece;

a pair of indexing beams adapted to be adjustably secured equidistant from each other in a first indexing direction on the rails, each indexing beam adapted to prevent movement longitudinally and laterally of a template holding frame, said template holding frame adapted to position successively a series of templates over the workpiece to rapidly develop a complex pattern therein by tracing the template patterns, and a vacuum clamp for holding the workpiece on the work-surface.

9. A vacuum fixture according to claim 8 wherein the vacuum clamp is secured to the work surface and comprises:

a source of compressed air, a valve element having a shut off connected to the source of compressed air, a venturi vacuum ejector, a pressure line connected to the venturi vacuum ejector through the valve, a sealing bead defining an area on said work surface with the underside of said workpiece as a vacuum chamber, an opening in the work surface into said vacuum chamber, a filter element, a line connecting the opening into said vacuum chamber and said filter element for removing moisture and contaminants from the evacuated air, and a second line downstream of said filter connected to said venture vacuum ejector for aspirating the air from said chamber and exhausting it to atmosphere for clamping the workpiece to the work surface.

* * * * *